US007182215B1

(12) United States Patent
Clardy

(10) Patent No.: US 7,182,215 B1
(45) Date of Patent: Feb. 27, 2007

(54) TRASH RECEPTACLE COLLAPSIBLE CLOSURE

(76) Inventor: Maurice Clardy, 76 Hood, Canfield, OH (US) 44406

( * ) Notice: Subject to any disclaimer, the term of this patent is extended or adjusted under 35 U.S.C. 154(b) by 412 days.

(21) Appl. No.: 10/880,137

(22) Filed: Jun. 30, 2004

(51) Int. Cl.
*B65D 51/00* (2006.01)

(52) U.S. Cl. ..... 220/287; 220/375; 220/720; 220/319; 229/125.34

(58) Field of Classification Search ..... 220/9.2, 220/9.3, 17.3, 780, 720, 375, 287, 84; 150/159
See application file for complete search history.

(56) References Cited

U.S. PATENT DOCUMENTS

| | | | | |
|---|---|---|---|---|
| 2,821,230 | A * | 1/1958 | May | 150/154 |
| 3,358,874 | A * | 12/1967 | Smith | 220/318 |
| 4,295,508 | A | 10/1981 | Metzger | |
| 4,339,056 | A | 7/1982 | Berkstresser, Jr. et al. | |
| 4,545,501 | A | 10/1985 | DeFord | |
| 4,723,686 | A | 2/1988 | Pennisi | |
| 5,078,295 | A | 1/1992 | Grant | |
| 5,297,692 | A | 3/1994 | Kronmiller | |
| 5,709,312 | A * | 1/1998 | Lake | 220/287 |
| 5,758,914 | A * | 6/1998 | Ioveno | 292/288 |
| 6,230,920 | B1 * | 5/2001 | Porter | 220/319 |
| 2006/0000836 | A1 * | 1/2006 | Lee et al. | 220/375 |

* cited by examiner

*Primary Examiner*—Anthony Stashick
*Assistant Examiner*—Christopher McKinley
(74) *Attorney, Agent, or Firm*—Harpman & Harpman

(57) ABSTRACT

A trash can closure cover to be used in place of existing lids to provide a resilient collapsible cover on the trash can that can be easily removed and retained thereon. The trash can closure defines a flexible sheet cover configuration to be resiliently retained temporarily over the open end of the receptacle trash can container that will be retracted and collapsed on itself as it is removed.

8 Claims, 4 Drawing Sheets

TRASH RECEPTACLE COLLAPSIBLE CLOSURE

BACKGROUND OF THE INVENTION

1. Technical Field

This invention relates to closures specifically large diameter trash receptacles of the type that are used to contain material within a trash can while awaiting pick-up and disposable.

2. Description of Prior Art

Prior art devices of this type have been directed to a variety of different lid designs to be used with trash containers, see for example U.S. Pat. Nos. 4,295,508, 4,339,056, 4,545,501, 5,078,295, 4,723,686, 5,297,692, and 5,758,914.

In U.S. Pat. No. 4,295,508 a flexible garbage can lid is disclosed in which a lid configuration having a defined shape of a lid is illustrated with a latch mechanism around a depending can engagement flange.

U.S. Pat. No. 4,339,056 is directed towards a lid tidy in which a flexible band secured around the base of a trash can the secondary flexible element extending from it and encircling a trash can lid so that the lid cannot be separated from the can after removal.

U.S. Pat. No. 4,545,501 a garbage can lid retainer is disclosed in which a flexible strap extends transversely over a garbage can lid and is attached by oppositely disposed hooks onto extending engagement elements on the can body.

U.S. Pat. No. 5,078,295 is directed towards a container lid securement apparatus in which a pair of resilient cords are used to inter-engage a modified handle in the center of a trash can lid and then extend to oppositely disposed handles on the sides of the can itself.

U.S. Pat. No. 5,297,692, a cover retainer means is disclosed which utilizes a strap configuration which extends over the surface of a trash can lid and is attached through a clip and buckle configuration to the handles on the trash can's base.

Finally, in U.S. Pat. No. 5,758,914 a garbage can lid tether is disclosed in which a flexible element is shown having a pair of clips on its oppositely disposed ends which are used to extend through a handle on a trash can lid and then engage in adjacent relationship on a handle thus preventing the lid from being separated from the can itself.

SUMMARY OF THE INVENTION

A flexible collapsible trash receptacle closure to be used in place of existing can lids. The closure of the invention provides for a flexible cover of synthetic sheet material having a contoured depending annular elastic band for engagement over the open end lip of the receptacle. A plurality of secondary retractable bands are movably positioned within guide channels on its surface to collapse the closure into a small surface area as it is removed. A flexible tether attachment retains the collapsed closure in communication with the receptacle.

DESCRIPTION OF PREFERRED EMBODIMENT

Figure 1:
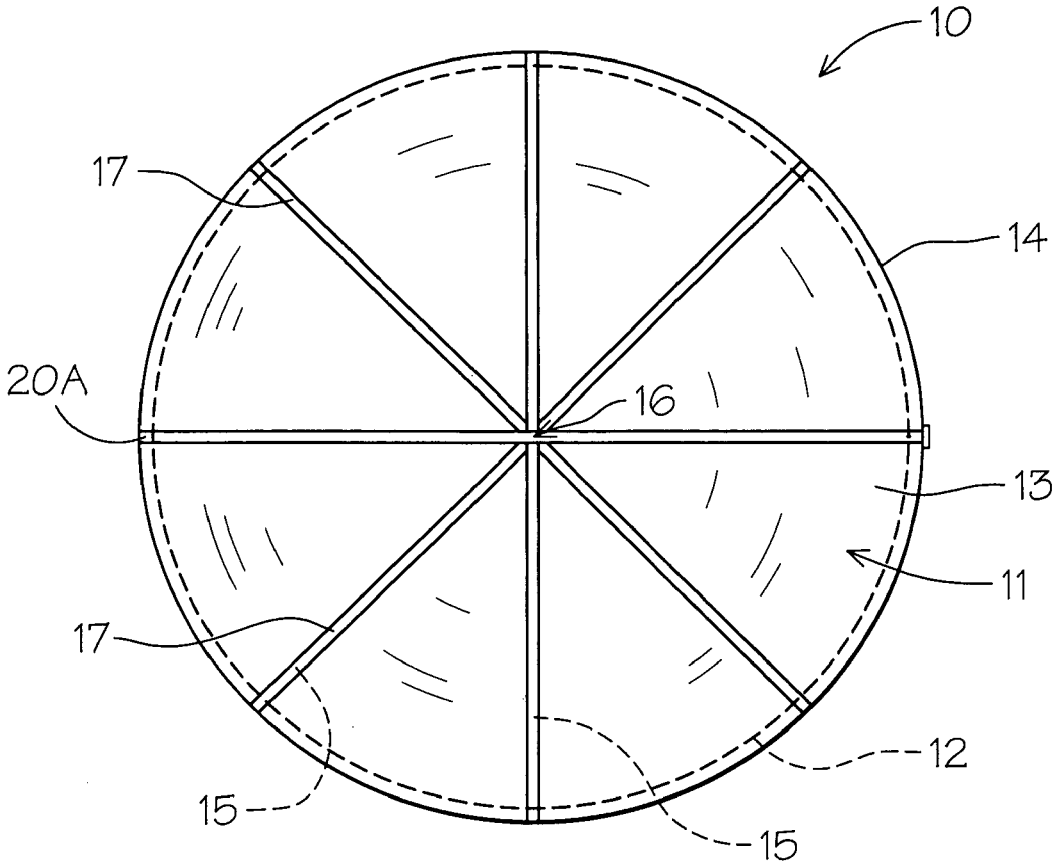
FIG. 1 is a top plan view of the collapsible closure of the invention.
Figure 2:
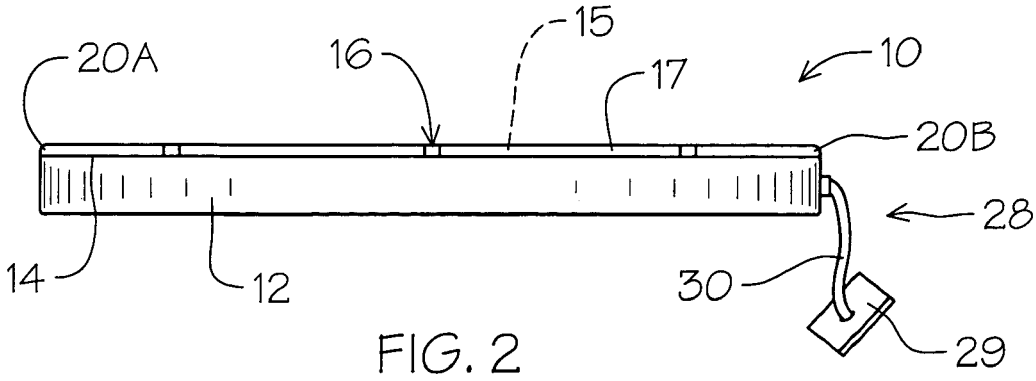
FIG. 2 is a side elevational view thereof.
Figure 3:
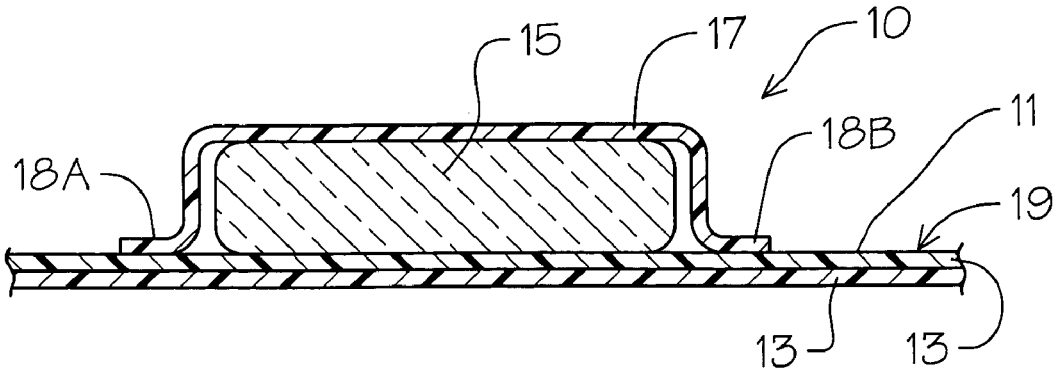
FIG. 3 is an enlarged partial cross-sectional view of an elastic retaining element on the closure.
Figure 4:
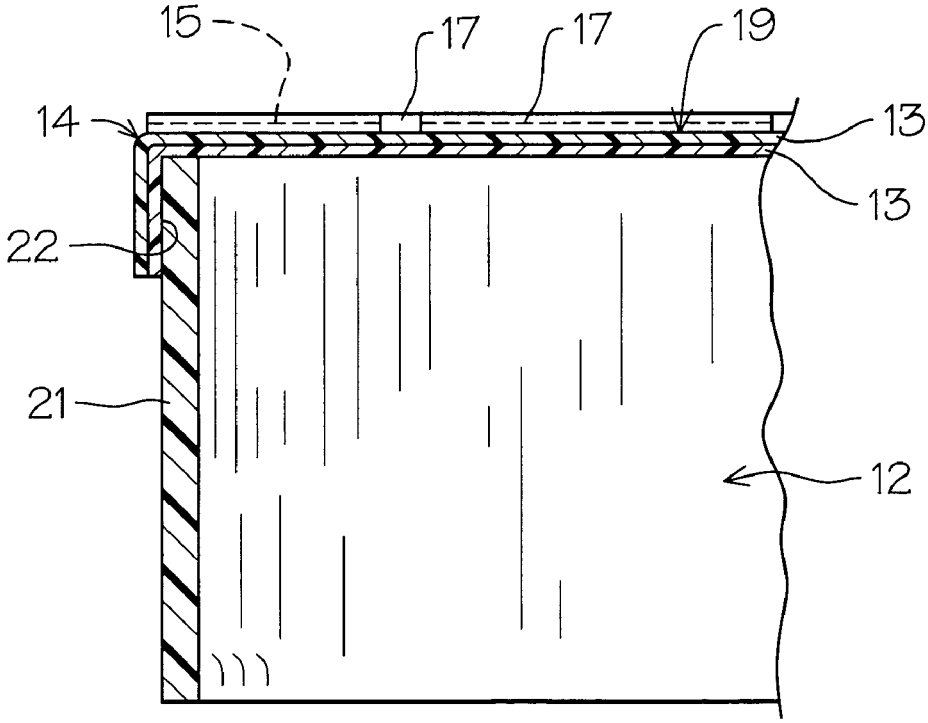
FIG. 4 is a partial cross-sectional view of the collapsible closure.

Referring to FIGS. 1–5 of the drawings, a trash receptacle cover closure 10 can be seen having a top 11 with an annular depending sidewall 12. The top 11 is formed from synthetic resin sheet material 13 of a circular configuration with a perimeter edge 14 thereabout. A plurality of elastic bands 15 extends transversely across the top 11 in annularly spaced relation to one another defining a radial pattern from a center intersection point 16, best seen in FIGS. 1 and 5 of the drawings. Each of the elastic bands 15 are movably positioned within a respective elongated closure guide channel 17 as seen in FIG. 3 of the drawings which may be formed in a variety of ways that as illustrated being bonded along oppositely disposed respective engagement edges 18A and 18B to an upper surface 19 of the synthetic resin sheet 13. The elastic bands 15 are secured at their respective ends 20A and 20B to the perimeter edge at 14 so as to be resiliently extended and stretched position during use as will be described in greater detail hereinafter.

Figure 5:
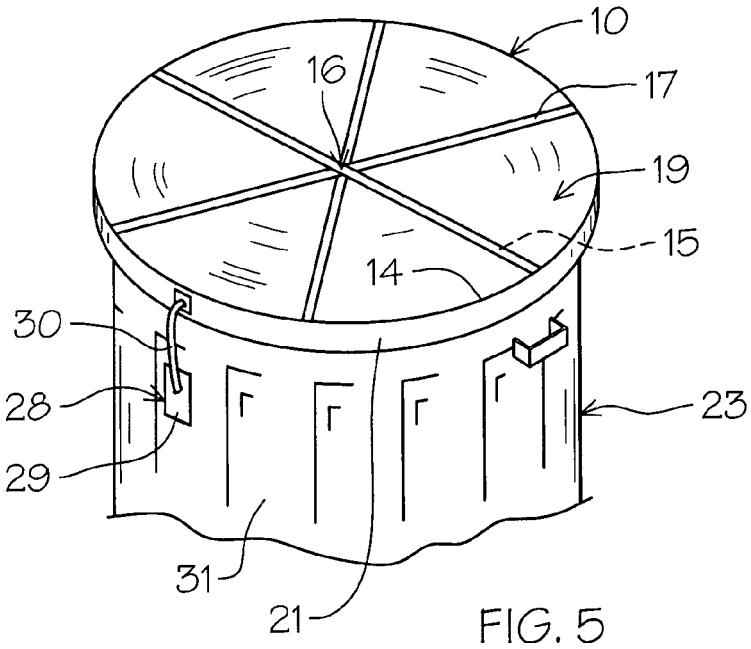
FIG. 5 is a partial perspective view of the collapsible closure secured on a trash receptacle.
Figure 6:
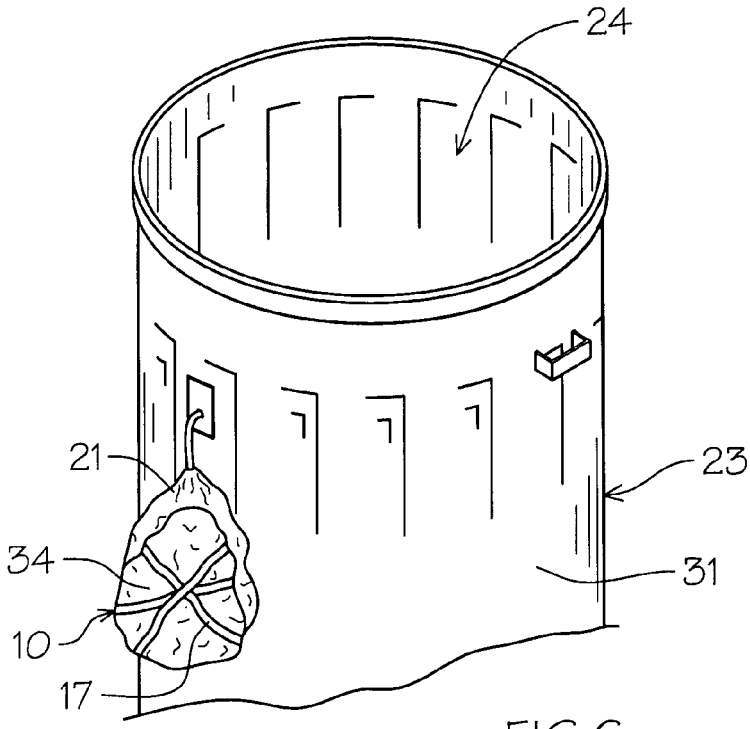
FIG. 6 is a partial perspective view of a trash receptacle with closure in collapsed removed orientation thereon.

The depending sidewall 12 is formed of a secondary wide band of elastic material 21 secured in this example to an overlapping edge portion 22 of the synthetic resin sheet 13's perimeter edge 14. It will be evident from the above description that given the material properties of the sheets 13 that the so configured closure cover 10 of the invention can be expanded and resiliently positioned and held over the open end 24 of a trash receptacle 23 as seen in FIGS. 5 and 6 of the drawings. The elastic band 21 of the sidewall 12 will engage and hold the expanded cover 10 with the multiple elastic bands 15 being stretched thereby to the maximum diameter of the sheet 13 which will be that of a dimension greater than that of the given opening at 24 of the receptacle.

Due to the flexible nature of the sheets 13, it will be evident that a variety of trash receptacle diameters and configurations can be accommodated thereby.

Referring now to FIGS. 2, 5 and 6 of the drawings, a restraint tether assembly 28 can be seen having a fixation pad 29 with a flexible cord 30 extending therefrom. The free end of the cord 30 is secured to the exterior surface depending sidewall 12 of the closure cover 10 of the invention.

The fixation pad 29 is preferably adhesively secured on an exterior surface 31 of the trash receptacle R in spaced vertical relation to a lip 32 of the receptacle that forms and defines the opening at 24 therein.

In use, the cover closure 10 is expanded and stretched and positioned onto the trash receptacle 23 over the opening 24 after it is filled as seen in FIG. 5 of the drawings. To empty the trash receptacle 23, it will be seen that as the closure cover 10 is pulled off the trash receptacle 23, it immediately snaps off retracting under the resiliency of the elastic bands 15 into a compact configuration 34 as shown in FIG. 6 of the drawings hanging from the attachment cord 30 out of the way allowing access to the receptacle container 23.

This retainment action assures that the cover closure 10 will not be lost or blown away after removal.

Figure 7:
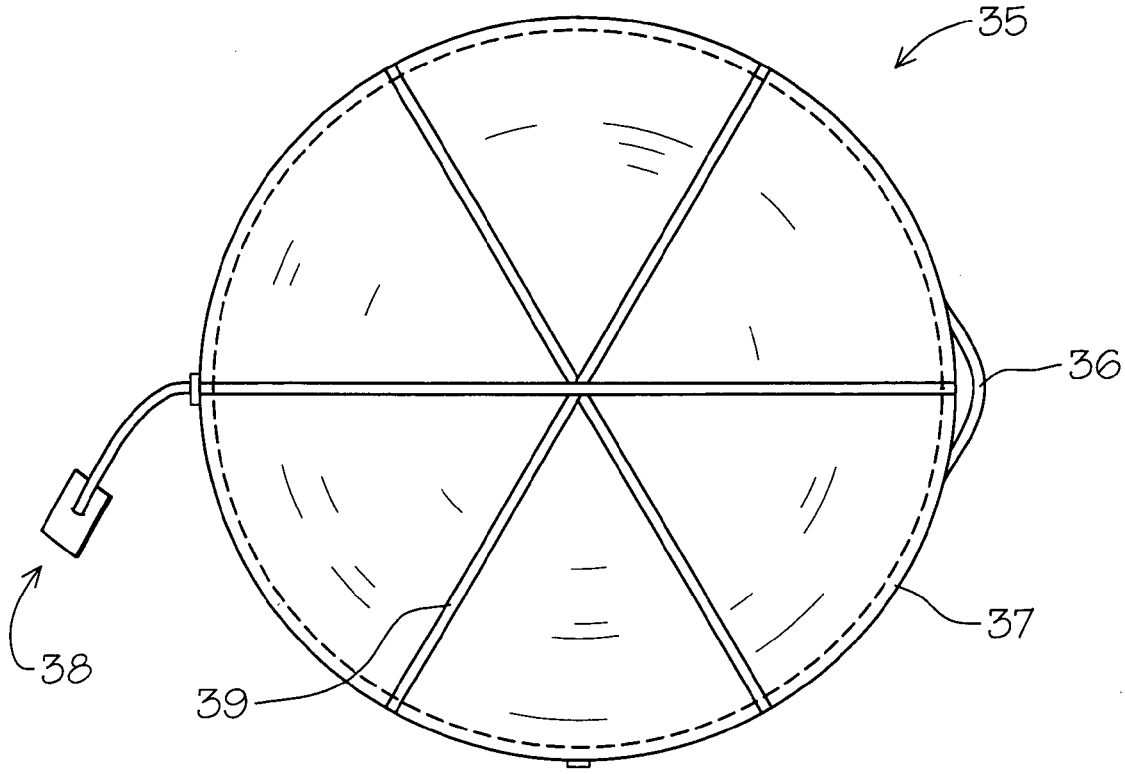
FIG. 7 is a top plan view of an alternate form of the invention.
Figure 8:
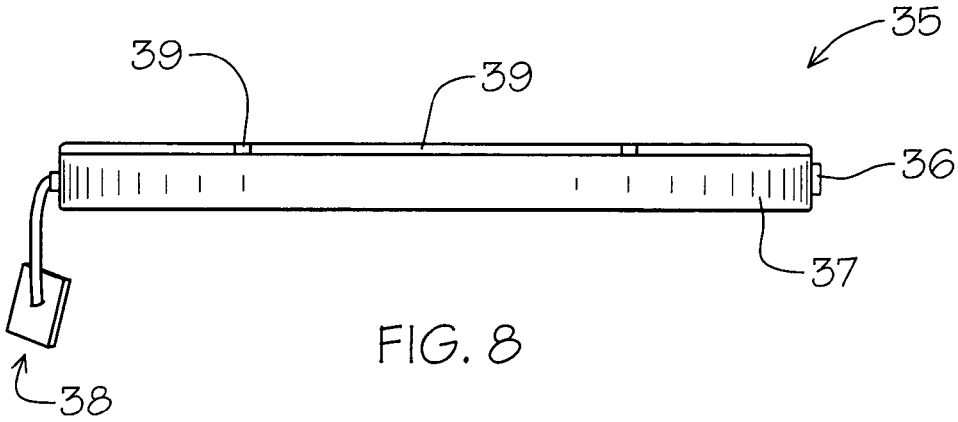
FIG. 8 is a side elevational view of the alternate form as seen in FIG. 7.

Referring now to FIGS. 7 and 8 of the drawings, an alternate form of the invention can be seen at 35 wherein the same general configuration of the preferred embodiment of the closure cover 10 is supplemented with addition of a fabric handle 36 secured to a depending elastic side engagement wall 37.

The handle 36 may be and is preferably positioned in oppositely disposed relation to a secondary retainment tether assembly 38 to provide a point of engagement for removal and placement of the alternate closure cover 35. Also an alternate cover retraction band placement can be seen wherein only three elastic bands 39 are criss-cross over the alternate closure cover 35.

It will thus be seen that a new and novel trash receptacle cover has been illustrated and described and it will be apparent to those skilled in the art that various changes and modifications may be made thereto without departing from the spirit of the invention.

I claim:

1. A closure for use on a receptacle can and the like comprising, a. a sheet of flexible material having a perimeter edge, b. a depending sidewall depending extending from said perimeter edge, c. said sidewall being of an integral elastic material, d. a plurality of transversely extending elastic bands on said sheet, guide means on said sheet for said elastic bands, inter-engagement means for portions of said bands to said sheets, a restraint tether extending from said closure to said receptacle.

2. The closure for use on a receptacle trash can set forth in claim 1 wherein said sheets of flexible material are preferably of a synthetic resin having a cross-polymer orientation.

3. The closure for use on a receptacle trash can set forth in claim 1 wherein said elastic bands on said sheet are in annularly spaced relation to one another about its perimeter.

4. The closure for use on a receptacle trash can set forth in claim 1 wherein said guide means on said sheets for said elastic bands comprises, elongated enclosure channels.

5. The closure for use on a receptacle trash can set forth in claim 1 wherein said inter-engagement means for portions of said elastic bands comprise, adhering oppositely disposed ends of said bands to said perimeter edge.

6. The closure for use on a receptacle trash can set forth in claim 1 wherein said resilient tether has a receptacle trash can attachment portion, with a flexible line extending therefrom.

7. The closure for use on a receptacle trash can set forth in claim 1 wherein said flexible sheet of material is of a known annular diameter greater than that of the opening defined by said receptacle trash can.

8. The closure for use of a receptacle trash can set forth in claim 1 further comprises, a handle on said depending sidewall oppositely said retainment tether for removal and placement of said closure on said receptacle trash can.

* * * * *